US007373940B1

(12) United States Patent
Lloyd

(10) Patent No.: US 7,373,940 B1
(45) Date of Patent: May 20, 2008

(54) FLEXIBLE HAIR CLIP AND COMB COMBINATION

(75) Inventor: Lisa V. Lloyd, Tucson, AZ (US)

(73) Assignee: Helen of Troy Limited, Barbados ( * ) Notice: Subject to any disclaimer, the term of this patent is extended or adjusted under 35 U.S.C. 154(b) by 89 days.

(21) Appl. No.: 10/721,672

(22) Filed: Nov. 25, 2003

(51) Int. Cl.
*A45D 8/22* (2006.01)
*A41F 1/00* (2006.01)

(52) U.S. Cl. ..... 132/278; 24/545

(58) Field of Classification Search ..... 132/273–284; 24/545, 547
See application file for complete search history.

(56) References Cited

U.S. PATENT DOCUMENTS 921,702 A * 5/1909 Howe ..... 132/279
2,795,233 A * 6/1957 Zore ..... 132/276
2,897,825 A * 8/1959 Wagner ..... 132/279
2,935,071 A * 5/1960 Waggener ..... 132/278
2,938,252 A * 5/1960 Scheemaeker ..... 24/67.9
3,076,465 A * 2/1963 Solomon ..... 132/283
3,082,773 A * 3/1963 Renstrom et al. ..... 132/278
3,412,739 A * 11/1968 Thatcher ..... 132/278
3,595,249 A * 7/1971 Solomon ..... 132/279
5,113,554 A * 5/1992 Gallo et al. ..... 24/545
5,762,076 A * 6/1998 Chan et al. ..... 132/278
6,095,155 A * 8/2000 Criscuolo ..... 132/278

* cited by examiner

*Primary Examiner*—Robyn Doan
(74) *Attorney, Agent, or Firm*—Mark Levy & Associates, PLLC

(57) ABSTRACT

The present invention is directed toward overcoming the disadvantages associated with previously known hairstyling devices, including but not limited to flexible snap clips. The apparatus incorporates a combination of a snap clip closure mechanism and a comb-like bottom with elongated teeth for gathering and holding hair.

6 Claims, 5 Drawing Sheets

FLEXIBLE HAIR CLIP AND COMB COMBINATION

FIELD OF THE INVENTION

The present invention relates to an apparatus to dress and hold hair and, more particularly, to gather all or sections of the hair in any number of desired positions.

BACKGROUND OF THE INVENTION

During hairdressing and preparation for activities, a variety of implements are employed for the purpose of maintaining the style and appearance of a person's hair. It is often desired to group strands of hair together so as to achieve a particular style. For example, ponytails are popular not only for the ease in which they may be cared for, but also for the comfort that they afford in keeping the hair away from the face. There are various other hairstyles in which several strands of hair join together for the purpose of fashion.

Heretofore, numerous devices have been developed for use in connection with the creation and maintenance of various hairstyles. One of the most commonly known prior devices is referred to as a snap clip. In their most basic sense, snap clips are typically formed of metal having a single, elongated, flat, narrow strip on the bottom for scooping under the desired gathered hair and a curved, top portion that can be concaved in a snap-like fashion to close over the gathered portion of hair.

While prior known hairstyling devices have known relative commercial success, none are without associated drawbacks or inherent limitations. For example, many prior devices are subject to inadvertent opening or difficulty in closing. This problem is particularly prevalent when it is necessary to grasp and secure large quantities of hair.

Another known shortcoming of current devices is their limitation in types of hair that they will hold. For example, only very small amounts of thick hair will work using current devices. Unfortunately, this eliminates most adult uses for this type of device and it has been limited to children's hair designs and markets.

It is therefore an object of the invention to provide a device to quickly and easily gather hair into any desired position on a person's head.

It is another object of the invention to bend a curved, open end of the top portion of a device into a concaved position, securing all types of hair gathered into place.

It is another object of the invention to create a device that has many more design options than what is currently available with the existing modes.

It is another object of the invention to create a device that holds all hair types in place.

SUMMARY OF THE INVENTION

Thus, the present invention is directed toward overcoming the disadvantages associated with previously known hairstyling devices, including but not limited to those discussed above. The inventive apparatus incorporates a novel combination of a snap clip closure mechanism and a plurality of elongated teeth for gathering and holding hair in fashionable and useful ways. The bottom portion of plural teeth and top portion of flexible material curves outward from the bottom portion and concaves into a closed position over the plural teeth holding the gathered hair in place.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the FIGURES.

DETAILED DESCRIPTION OF THE PREFERRED EMBODIMENT

The present invention is an improved snap clip for use with a person's hair. The clip permits quick and easy gathering of both thin and thick hair.

Figure 1:
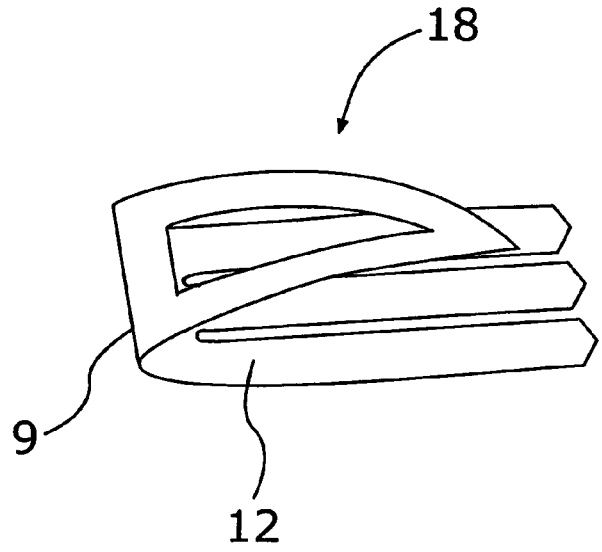
FIG. 1 is a perspective view of a clip in accordance with the invention, illustrated in the closed position.

FIG. 1 is a perspective view of the improved snap clip of the present invention, shown generally at reference numeral 18. The lower portion 12 of the clip 18 has a plurality of comb-like, spaced apart teeth. In the preferred embodiment, a first tooth 15, second tooth 16 and third tooth 17 are provided, as shown, but any number of teeth, greater than one, can be used in the snap clip 18. Each tooth 15, 16, 17 has a free end that remains free at all times. Moreover, the teeth need not be the same length. A flexible upper portion 10 is the same length as the lower portion 12 when the clip 18 is in the closed position, as shown in FIG. 1. Connecting the upper portion 10 and the lower portion 12 of the clip 18 is a living hinge 9, well known in the art. The upper portion 10 is concave.

Figure 2:
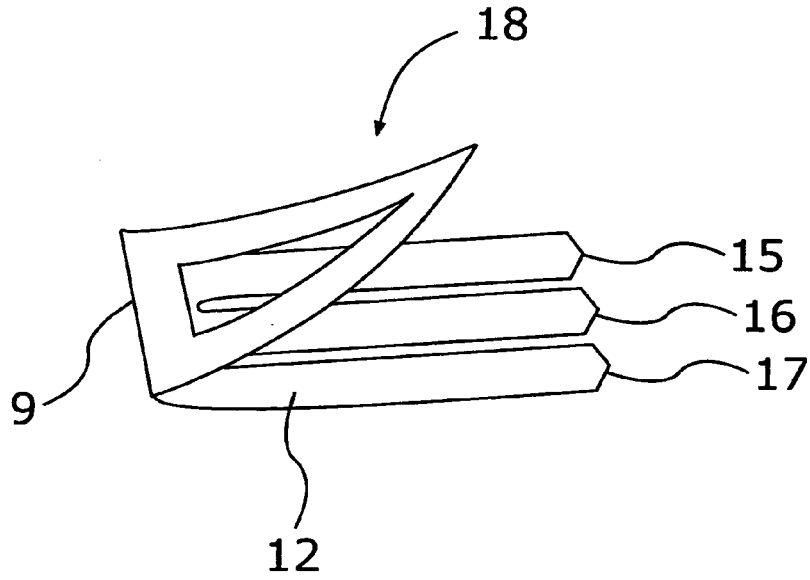
FIG. 2 is a perspective view of a clip in accordance with the invention, illustrated in the open position.

FIG. 2 is a perspective view of the clip 18 in its open position, the upper portion 10 being separated from the lower portion 12 by means of a hinge 9.

Figure 3:
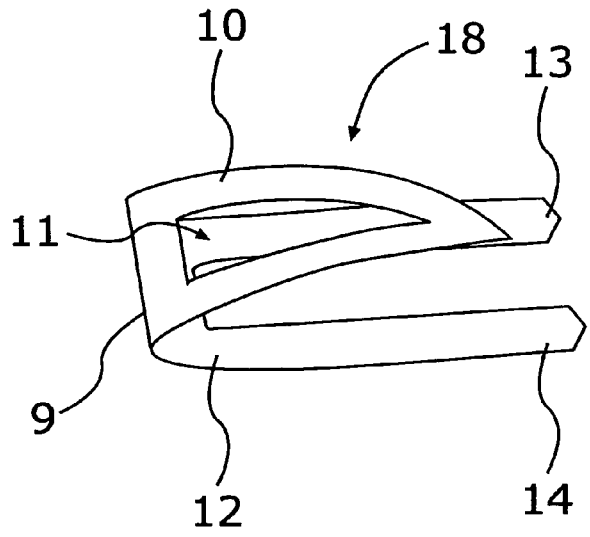
FIG. 3 is a perspective view of an alternate embodiment of an open hair clip, illustrating two widely spaced, comb-like teeth on the bottom portion.

FIG. 3 is a perspective view of an alternate embodiment of the clip 18 in its open position. An upper tooth 13 and lower tooth 14 form a comb on the bottom portion 12. The lower portion 12 is substantially longer than the concave upper portion 10 when in a closed position. An aperture 11 is provided.

Figure 4:
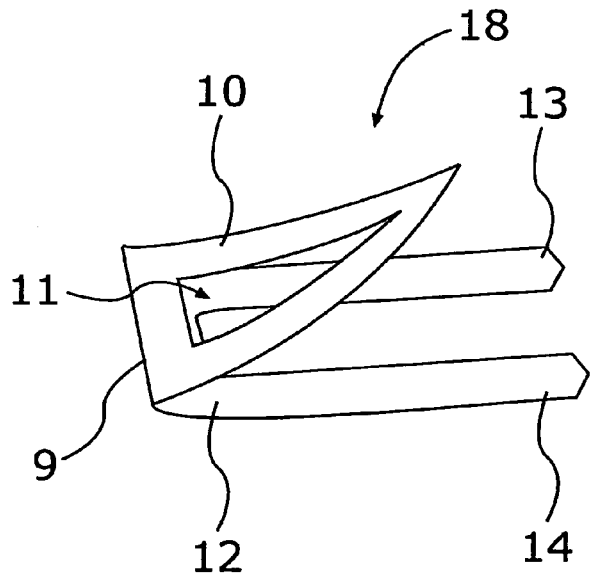
FIG. 4 is a perspective view of the clip shown in FIG. 3 in a closed position.

FIG. 4 is a perspective view of the clip 18 in its closed position 21.

Figure 5:
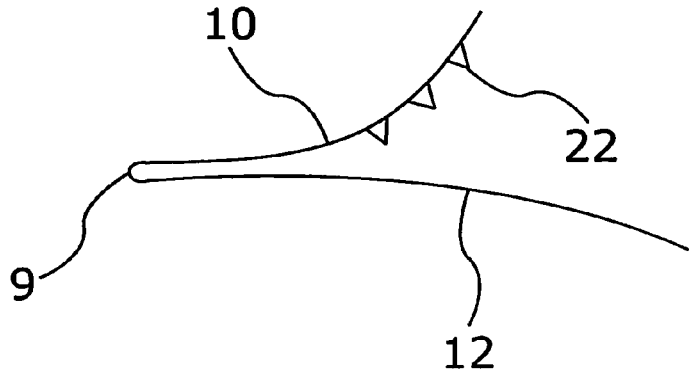
FIG. 5 is a side view of an open clip.

FIG. 5 is a side view of an open clip 18 illustrating the upper portion 10 and lower portion 12 revealing interior teeth 22 on the bottom surface of the upper portion 10. Interior teeth 22 are used to help retain hair, not shown, in its desired position relative to the upper portion 10 and lower portion 12 of the clip 18.

Figure 6:
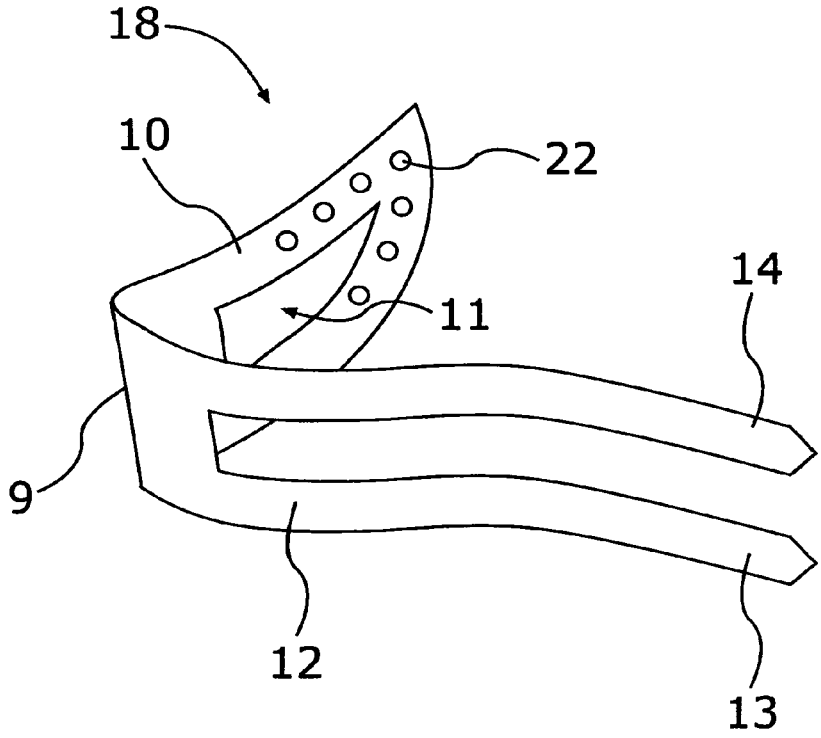
FIG. 6 is a perspective bottom view of an open clip.

FIG. 6 is a perspective bottom view of the clip 18 in its open position. In this embodiment, the bottom surface of the upper portion 10 has interior teeth 22 spaced evenly along the bottom surface of the upper portion 10, surrounding the aperture 11. It should be understood, however, that the upper portion 10 can be of any shape, with or without an aperture, and that the interior teeth 22 need not be uniformly spaced as shown in FIG. 6.

Figure 7:
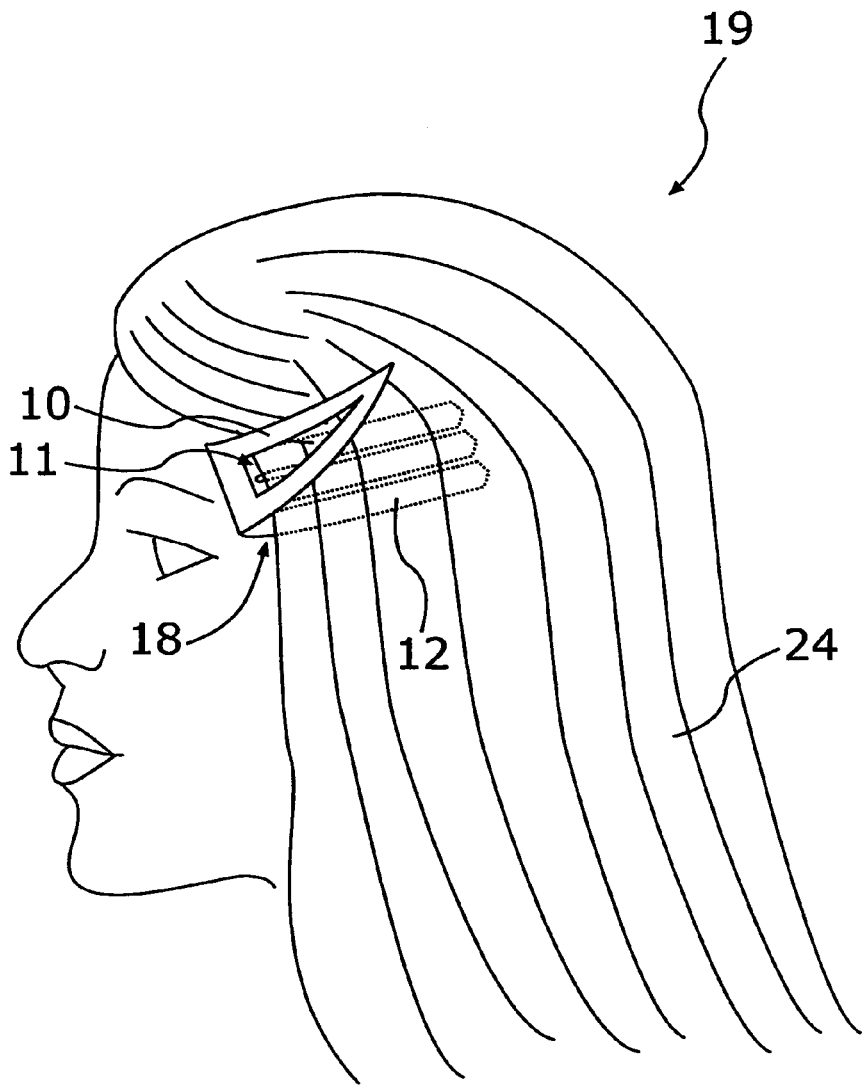
FIG. 7 is a perspective view of an open clip applied to the hair of a woman's head.

FIG. 7 illustrates a woman 19 with an open clip 18, as shown in FIGS. 3-6, illustrating how to gather the hair 24 into the desired style.

Figure 8:
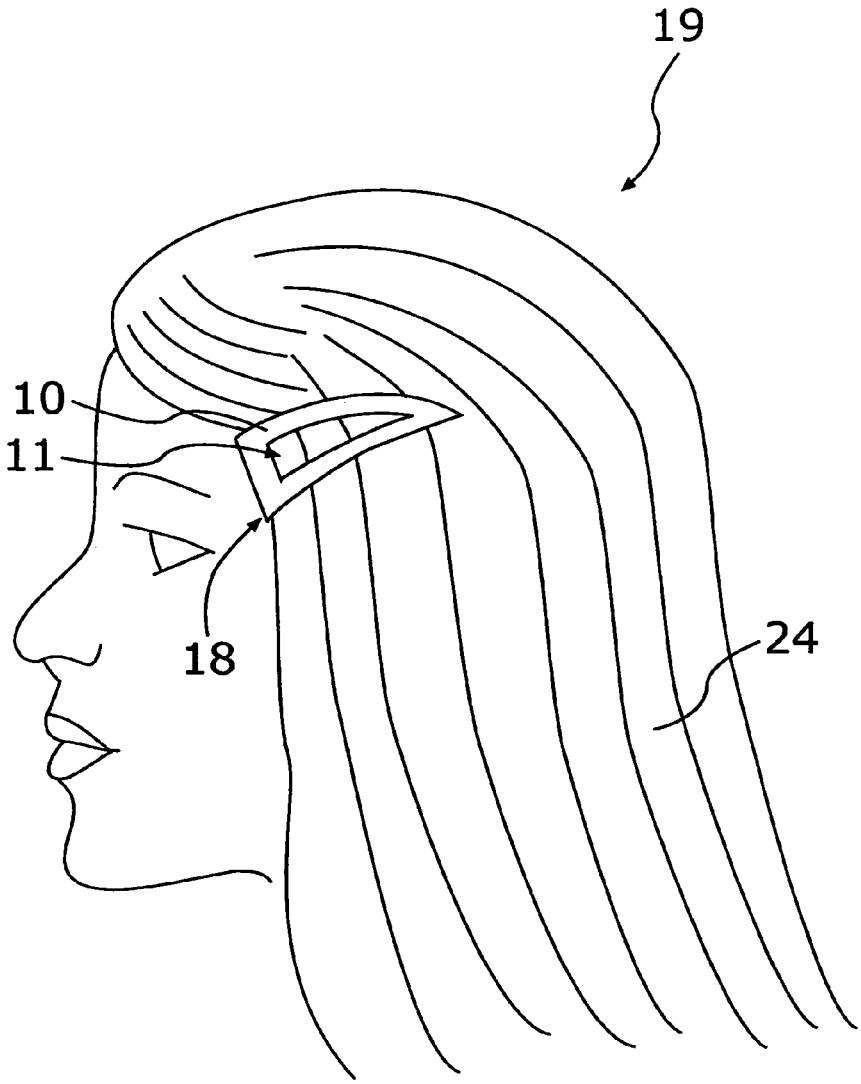
FIG. 8 is a perspective view of the clip shown in FIG. 7, in a closed position, holding the hair in place.

FIG. 8 illustrates the woman 19 wearing a closed clip 18, illustrating how it looks in one possible style, the hair 24 being drawn back away from the face.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of the invention.

Having thus described the invention, what is desired to be protected by Letters Patent is presented in the subsequently appended claims.

What is claimed is:

1. A one-piece flexible hair clip and comb combination for styling and holding all, or sections of hair comprising:

a) means for gathering the upper portion of hair in position and holding the hair in a desired position;

b) means for a combing action and holding larger amounts of hair in place, integrally connected to said means for gathering the upper portion of hair and holding the hair in a desired position;

c) wherein said means for a combing action and holding larger amounts of hair in place comprises a bottom lower portion with a plurality of planar teeth of spring-like material, each of said teeth having a free end, wherein each of said teeth extends parallel to the length of said means for gathering the upper portion of hair, each of said free ends of said teeth remaining free at all times; a plurality of protuberances formed on an interior side of said upper portion, providing additional hold of gathered hair in closed position of said hair clip;

d) wherein said lower portion is at least as long as said upper portion;

e) wherein said planar teeth of said lower portion extend laterally beyond the periphery of said upper portion; and f) wherein said means for gathering the upper portion of hair in position and holding the hair in a desired position comprises a top upper portion of spring-like material that is flexible between a stable convex open position and a stable concave closed position.

2. The one-piece flexible hair clip and comb combination for styling and holding sections of hair in accordance with claim 1, wherein said spring-like material is spring steel.

3. The one-piece flexible hair clip and comb combination for styling and holding sections of hair in accordance with claim 1, further comprising a plurality of protuberances formed on a interior side of said upper portion, providing additional hold of gathered hair in closed position of said hair clip.

4. The one-piece flexible hair clip and comb combination for styling and holding sections of hair in accordance with claim 1, wherein said means for a combing action and holding larger amounts of hair in place is hingedly connected to said means for gathering the upper portion of hair and holding the hair in a desired position.

5. A one-piece flexible hair clip and comb combination for styling and holding sections of hair comprising:

a) an upper portion of spring-like material is flexible between a stable convex open position and a stable concave closed position;

b) a lower portion of spring-like material, with a plurality of planar teeth extending parallel to the length of said upper portion, facilitating a combing action and holding larger amounts of hair in place, said lower portion being integrally connected to said upper portion, said lower portion being at least as long as said upper portion, said lower portion extending laterally beyond the periphery of said upper portion;

c) a plurality of planar teeth in said lower portion forming a comb, each of said teeth having a free end;

d) a plurality of protuberances formed on an interior side of said upper portion, providing additional hold of gathered hair in closed position of said hair clip, wherein each of said ends of said plurality of planar teeth remains free at all times.

6. A one-piece flexible hair clip and comb combination for styling and holding sections of hair in accordance with claim 5, wherein said lower portion is hingedly connected to said upper portion.

* * * * *